United States Patent [19]

Fencl

[11] 3,965,627

[45] June 29, 1976

[54] INTERCONNECTION OF MODULAR STRUCTURES

[76] Inventor: Miroslav Fencl, 59-28 57th Drive, Flushing, N.Y. 11378

[22] Filed: May 9, 1975

[21] Appl. No.: 576,220

Related U.S. Application Data

[63] Continuation-in-part of Ser. No. 485,462, July 15, 1974, abandoned, which is a continuation-in-part of Ser. No. 294,391, Oct. 12, 1972, abandoned, which is a continuation-in-part of Ser. No. 289,935, Sept. 18, 1972, abandoned, which is a continuation-in-part of Ser. No. 143,547, May 14, 1971, abandoned.

[52] U.S. Cl. ..... 52/79; 52/126; 52/227

[51] Int. Cl.[2] ..... E04H 9/06

[58] Field of Search ..... 52/125, 122, 236, 227, 52/79, 126

[56] References Cited

UNITED STATES PATENTS

| | | | |
|---|---|---|---|
| 3,110,982 | 11/1963 | Besinger | 52/648 X |
| 3,429,092 | 2/1969 | Perry | 52/236 X |

FOREIGN PATENTS OR APPLICATIONS

| | | | |
|---|---|---|---|
| 608,401 | 9/1960 | Italy | 52/79 |

*Primary Examiner*—John E. Murtagh

[57] ABSTRACT

An interconnection of a structure comprising a modular assembly and a substructure supporting it. The assembly consisting of several stories is composed of a plurality of self-supporting modules, each having the form of a rectangular tube. Modules are assembled in a "stack-bond" fashion, overlapping one another on adjacent sides fully, or partially.

The vertical interconnection of the structure is secured typically by rods threaded at bottom, at top provided with a nut head or expanded into the form of a cap adapted to receive the bottom of the rod. Rods are connected to the substructure by means of pegs of which the shape is similar to the rod cap. Pegs are attached to plates and such subassemblies are anchored in the substructure. Both rods and pegs are encased in pipes which are embedded in walls of modules. A fixture attached inside the pipe at its top, provides a seat for the rod cap and also serves for the attachment of bolts of the lifting device.

The lateral interconnection of the structure is secured by plates cooperating with rod caps. Holes are provided in plates in positions corresponding with rod caps. Plates are installed over particular groups of adjacent pipes.

3 Claims, 10 Drawing Figures

INTERCONNECTION OF MODULAR STRUCTURES

CROSS REFERENCE TO RELATED APPLICATIONS

This application is a continuation-in-part of the now abandoned application Ser. No. 485,462 filed on July 15, 1974, which was a continuation-in-part of the now abandoned application Ser. No. 369,562 filed on June 13, 1973, which was a continuation-in-part of the now abandoned application Ser. No. 294,391 filed on Oct. 12, 1972, which was a continuation-in-part of the now abandoned application Ser. No. 289,935 filed on Sept. 18, 1972, which was a continuation-in-part of the now abandoned application Ser. No. 143,547 filed on May 14, 1971.

From the technical point of view, this application is closely related to 2 applications submitted by this applicant under Ser. No. 472,925 filed on May 23, 1974 and under Ser. No. 485,461 filed on July 15, 1974, both a continuation-in-part of the abandoned application Ser. No. 369,562 mentioned above.

BACKGROUND OF THE INVENTION

This invention has found its antecedence in the related invention submitted under Ser. No. 472,925 titled COORDINATED MODULAR BUILDING CONSTRUCTION, and Ser. No. 485,461 titled STRUCTURE OF COORDINATED MODULAR BUILDING CONSTRUCTION. It represents the preferred embodiment of mentioned related inventions with respect to the structural interconnection of modules.

The primary object of this invention if a thorough exploration of the technical and economical feasibility of the concept with which the mentioned invention COORDINATED MODULAR BUILDING CONSTRUCTION deals.

SUMMARY OF THE INVENTION

This invention is generally applicable to any structure constructed of volumetric components. It is presented here in its application to the afore mentioned inventions of this applicant submitted under titles: COORDINATED MODULAR BUILDING CONSTRUCTION and STRUCTURE OF COORDINATED MODULAR BUILDING CONSTRUCTION. It deals also with the mode of the connection of the modular cluster with the substructure presented as an example in FIG. 5 by a grade story of which the structure consists of frames supporting the bearing walls of the modular cluster, the frames being braced laterally by girders.

In order to simplify the issue, the effect of the grout applied on contacting surfaces between modules is neglected though it has a connecting function too.

The proposed method secures the investigated structure basically in two directions: vertically and laterally. The vertical interconnection is accomplished by rods in cooperation with pipes embedded in walls of modules. The location of pipes is exemplified in FIG. 5. The exact position of pipes within the wall structure is governed by rules of the coordinating system according to which the center of the pipe is positioned on the intersection of 2 lines - one running parallelly within uniform distance D from the grid line defining particular segmental depth (SD), the other line running parallelly within uniform distance T from the grid line defining particular modular width (MW)-as illustrated in FIG. 3, 4A-D, 5, 6, 7. Rods are expanded at top into the form of a cap and are interconnected in a "bottom to top" fashion. A fixture immovably attached inside the pipe near its top is functioning as a fixed seat to receive the bottom of the rod cap. Rods are interconnected by screwing while the fixture causes tension on the rod, thus connecting the particular portion of the upper module with the adjacent module below. Pegs of which the shape is similar to that of the rod cap and also functioning similarly, are anchored in the substructure, thus securing the connection of a modular cluster with the substructure. Superstructures, such as roof parapets, railing walls etc., are connected with the particular module by rods which are extended into the superstructure and encased in pipes 14 (FIG. 1) which are embedded in the superstructure. Rods of the top modular story are provided with the nut head instead of a cap, and so are rods used at the particular module in which the vertical interconnection is terminating (FIG. 7) such as the case marked by the circle G in FIG. 5. In cases where the vertical interconnection starts at the intermediate story, plugs 15 (FIG. 6) are used as a substitute for the rod cap. Plugs of which the shape is similar to that of the rod cap, are screwed into the fixture in which a threaded aperture has been provided. Such aperture serves also for the attachment of the lifting frame.

The lateral interconnection of the structure is secured by plates with holes provided, in cooperation with rod caps or pegs or plugs, plates being held in position by the weight of the module above imposed on the module below, or on the substructure. At the top modular story, rods 7 (FIG. 1) are inserted into holes of plates and connected with the rod caps of the lower module. In order to facilitate the operation of the engagement of the rod with the rod cap, plug or peg, a funnel-shaped fixture 10 (FIG. 2) may be used, which guides the bottom of the rod into the aperture of the rod cap, plug or peg.

Advantages of the described mode of an interconnection of modular structures are:

1. The entire process requires no access from the interior space of modules, so that they can be fully precompleted in the factory before installation on place.
2. The method consists of simple mechanical operations and does not require specially skilled labour.
3. The hardware - rod caps, plugs, pegs, projecting above the particular modular story or the substructure, serve as the guiding device facilitating the installation of the upper modular story.
4. The hardware functions in conjunction, securing the structure simultaneously in the vertical and the lateral direction.
5. Plates serve as separators, securing the presence of the grout in horizontal joints.
6. The fixture affixed in the pipe at top, serves for the attachment of the bolt of the lifting frame, thus eliminating the need for any other means to perform such function.
7. Pipes, besides their connecting function, serve simultaneously as the vertical reinforcement of the modular structure and also as dowels to interconnect structural components within the particular modular structure.
8. Levelling shims easily rectify any eventual horizontal misalignment of adjacent surfaces of modules at the top of each modular story.

DESCRIPTION OF THE PREFERRED EMBODIMENTS

Figure 5:
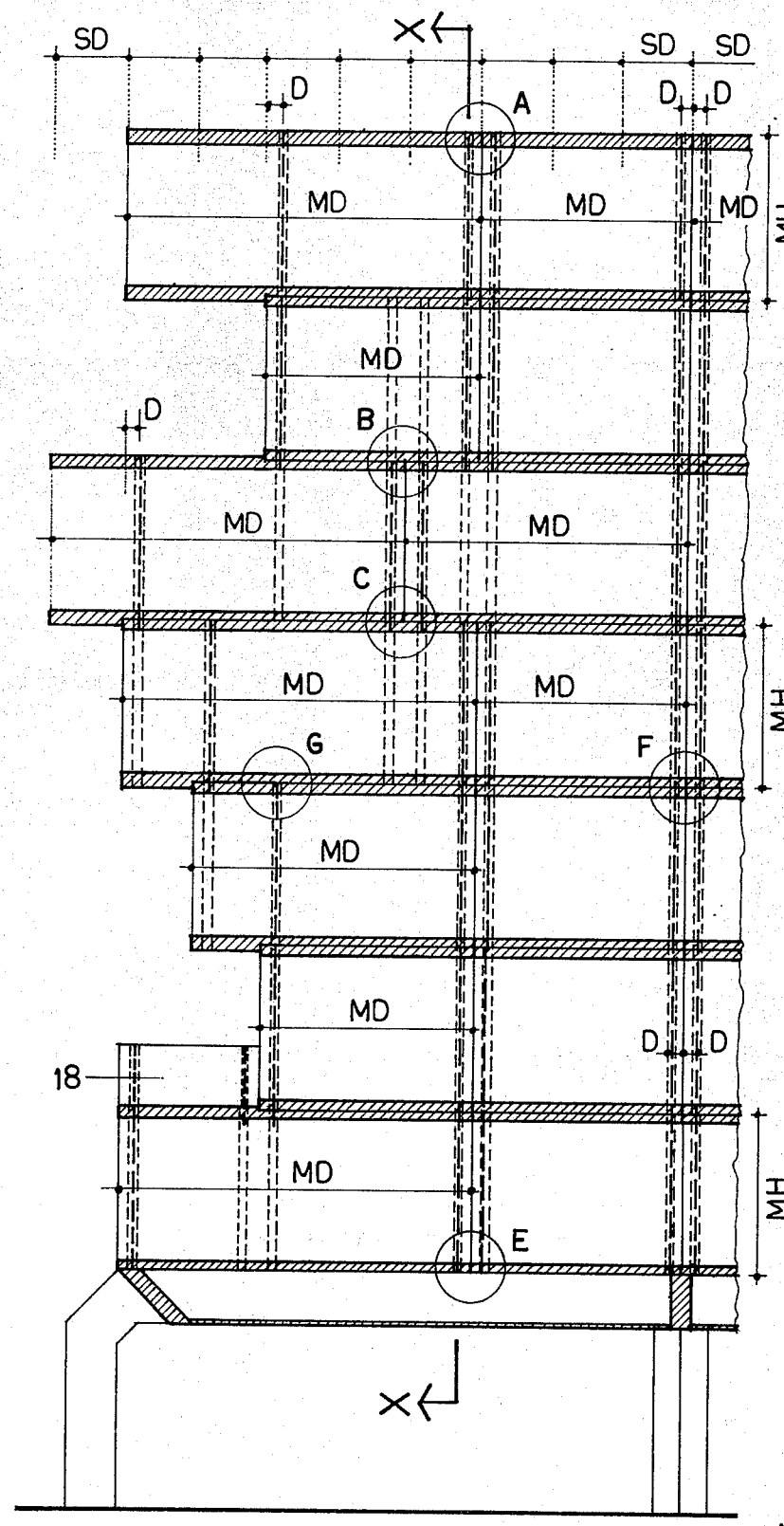
FIG. 5 shows the vertical section cut through a portion of the structure. It is applied parallelly to the walls of modules.

The structure in question is illustrated as an example in FIG. 5. Modular dimensions are: modular width (MW), modular heigth (MH), modular depth (MD). In accordance with the mentioned related invention COORDINATED MODULAR BUILDING CONSTRUCTION, modular depth consists of several segmental depths (SD) such a dimension being uniform. The modular cluster is assembled in a "stack-bond" fashion, i.e. "wall beside wall, front-end to back-end, floor-slab over ceiling-slab". All sides of modules contained inside the cluster are fully overlapping. At the exterior of the cluster, some sides may overlap the adjacent side only partially. Thus, following conditions may occur, which are decisive for the particular type of the connecting hardware to be used:

A. Typical situation indicated in FIG. 5 by a circle F and shown in detail in FIG. 2, in which both rod and plate interconnection runs through the joint.

B. A situation indicated in FIG. 5 by a circle E and shown in detail in FIG. 3, in which the first modular story is connected with the substructure.

Figure 1:
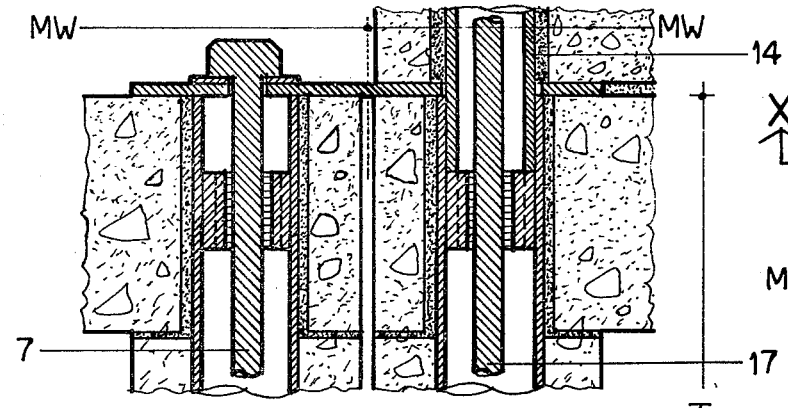
FIG. 1 is a fragmentary vertical section cut as indicated in FIG. 5 and FIG. 4A,4C,4D by the mark X — X. It illustrates the hardware near the ceiling-slab of the top modular story.

C. A situation indicated in FIG. 5 by a circle A and shown in detail on the left side of FIG. 1, in which the interconnection terminates at the top of the structure.

D. A situation shown on the right side of FIG. 1, in which a superstructure is connected with the top of the mdular structure at the roof level or on the top of the projected module at any story where terrace is desirable.

E. A situation indicated in FIG. 5 by a circle B, in which the vertical interconnection terminates at the lower story and the lateral interconnection is still needed. In this case, in order to provide space for projecting rod caps, pipes are embedded in the upper module.

F. A situation indicated in FIG. 5 by a circle G and shown in detail in FIG. 7, in which the vertical interconnection terminates at the lower story and lateral interconnection is not needed.

Figure 6:
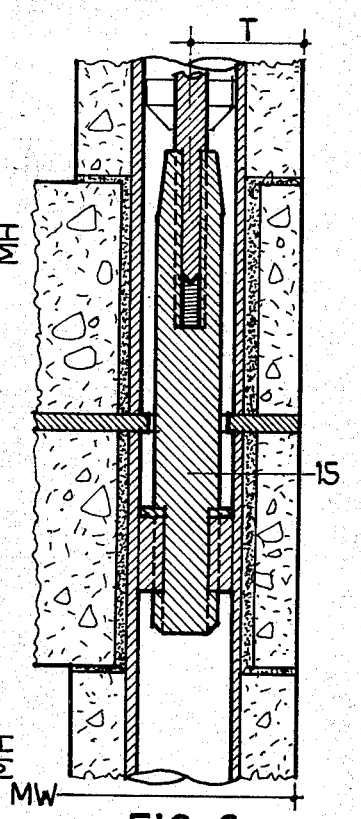
FIG. 6 is a fragmentary vertical section cut as described in FIG. 1. It illustrates the hardware located at the end wall near the doubled-floor structure under conditions marked by a circle C in FIG. 5.

G. A situation indicated in FIG. 5 by a circle C and shown in detail in FIG. 6, in which the vertical interconnection commences at the intermediate modular story rather than at substructure.

Figure 3:
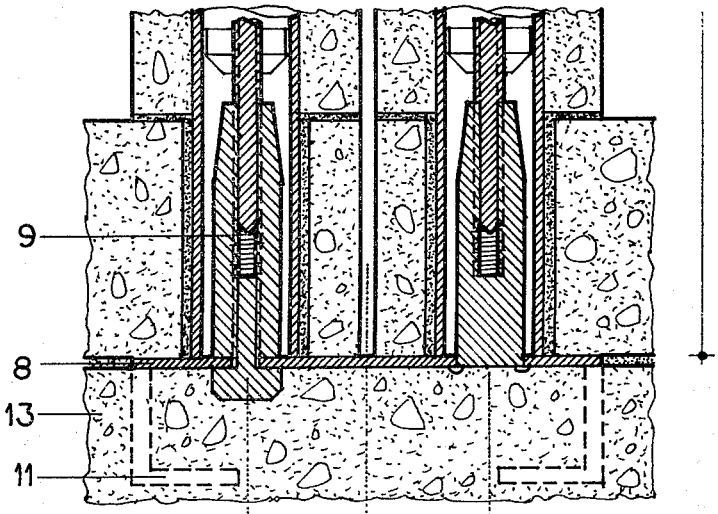
FIG. 3 is a fragmentary vertical section as described in FIG. 1. It illustrates the hardware located near the floor-slab of the first modular story and the substructure.
Figure 4A:
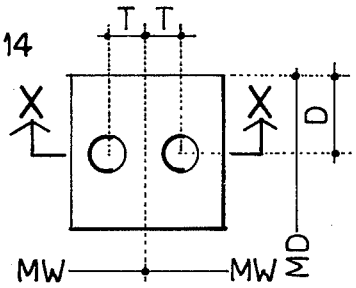
FIG. 4A illustrates the shape of the connecting plate applied at the perimeter of the building where two adjacent modules meet in the "wall beside wall" manner.
Figure 4B:
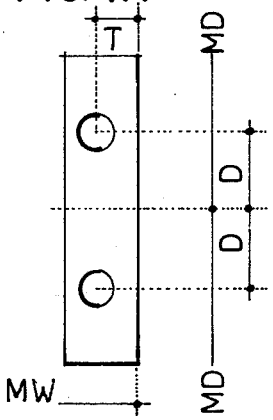
FIG. 4B illustrates the shape of the connecting plate applied at the perimeter of the building where two adjacent modules meet in the "wall-end to wall-end" manner.
Figure 4C:
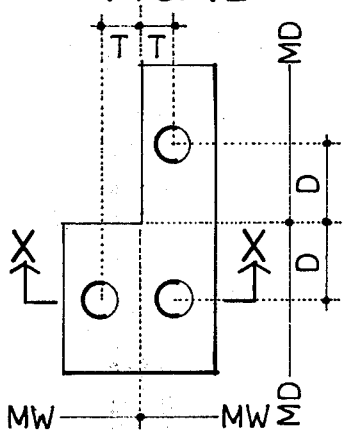
FIG. 4C illustrates the shape of the connecting plate applied at the nook of the perimeter of the building where three modules meet at their corners.
Figure 4D:
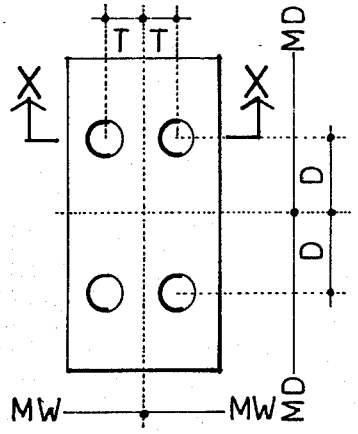
FIG. 4D illustrates the typical shape of the connecting plate applied inside the building where four modules meet at their corners.

The hardware then comprizes following parts to provide for all described situations:

1. Pegs 9 — plate 8 subassembly (FIG. 3). The subassembly is firmly connected with the substructure 13 — for example by anchors 11. Pegs are attached to plates securely, by bolts, by welding, or otherwise. Pegs are penetrated at top by a threaded aperture to receive the bottom of the connecting rods.

Figure 2:
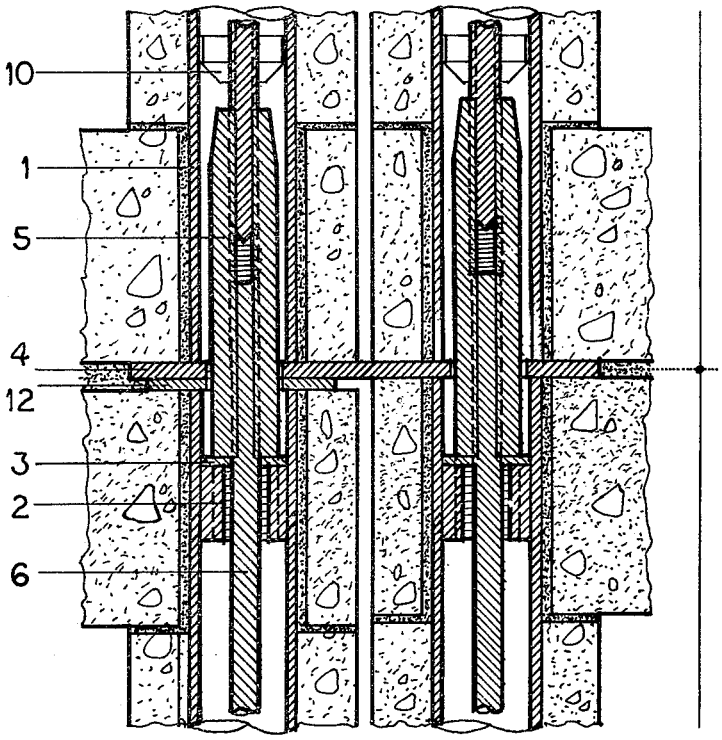
FIG. 2 is a fragmentary vertical section as described in FIG. 1. It illustrates the hardware located at the doubled-floor structure.
Figure 7:
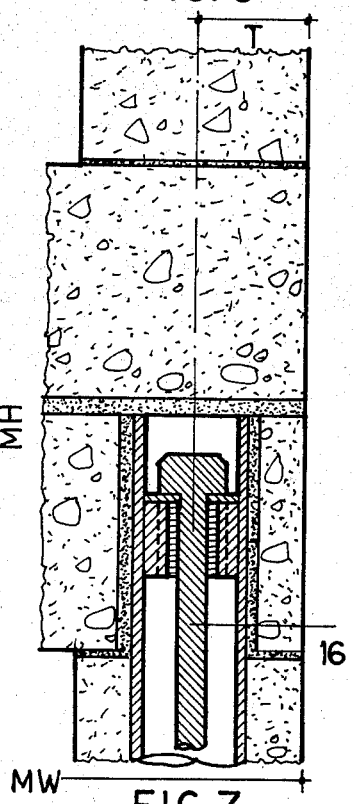
FIG. 7 is a fragmentary vertical section cut as described in FIG. 1. It illustrates the hardware located at the end wall near the doubled-floor structure under conditions marked by a circle G in FIG. 5.

2. Pipe 1 — fixture 2 — fixture 10 subassembly (FIG. 2). This subassembly is embedded in vertical position in walls of modules and located as determined by the structural design (FIG. 5). The fixture 2 is immovably attached inside the pipe and positioned so that sufficient space is left between the top of the pipe and the top of the fixture to accomodate a nut head of the connecting rod if used (FIG. 7). The fixture 2 is penetrated by a threaded aperture designed to receive bolts of the lifting device and simultaneously to allow for the free passage of the connecting rod. The fixture 10 fits snugly inside the pipe and is positioned so that some space is left between the bottom of the fixture and the top of the rod cap, plug 15 (FIG. 6) or peg 9 (FIG. 3). Fixture 10 is formed in the shape of a funnel to perform its function as a guiding device facilitating the engagement of the rod with the rod cap, plug, or peg.

3. Connecting rod 7 (FIG. 1) or 16 (FIG. 7) with nut head at top and a threaded bottom. Rods 7 and 16 differ only in length.

4. Rod 6 — cap 5 — washer 3 subassembly (FIG. 2). The cap, designed to fit the inside diameter of the pipe with some tolerance allowed, may be formed by hot forging process directly out of the rod, or it is immovably attached to the rod. The top of the cap is penetrated by a threaded aperture to receive the threaded bottom of connecting rods.

5. Connecting plug 15 (FIG. 6) of which the upper portion is formed in the same shape as the rod caps, whereas the bottom of the plug is formed as a threaded dowel to fit the threaded aperture of the fixture 2.

6. Connecting plates 4 (FIG. 2) of which the typical shapes are shown in FIG. 4A–D, with holes provided to fit the outside diameter of rod caps, plugs, or pegs.

7. Levelling shims 12 (FIG. 2) having the form of a washer of which the hole fits the outside diameter of rod caps or plugs.

The process of the interconnection of the described structure is performed in following operations:

1. Peg and plate subassemblies are installed by grouting anchors in pits left out in the substructure. Pegs project above the substructure and are positioned exactly to match the pattern of pipes of the first modular story.

2. Modules of the first story are installed, projecting pegs facilitating the operation (FIG. 3).

3. Connecting rods of the first modular story are inserted into pipes from the top of the first story, rods are engaged with pegs and rods are tightened by screwing. The fixture 2 seating the bottom of the rod cap causes tensile stresses in the rods, thus connecting the modules of the first story with the substructure by post-tensioning.

4. Eventually (if top surfaces of adjacent modules are not at the same level), levelling shims 12 (FIG. 2) are used to rectify the misalignment.

5. Connecting plates are installed over projecting rod caps (FIG. 2). If plugs 15 should be used, they are installed before plates are installed. The same applies if rods 16 are used.

6. Modules of the second story are installed and the process is repeated until the construction reaches the top modular story.

7. At the top story, plates are installed before rods 7 (FIG. 1) are applied. Thereafter rods are inserted through holes in plates and tightened. If a superstructure is connected with the modular cluster, extension pipes 14 are installed, then grouted in the superstructure and the extended rod 17 is installed and tightened against the top of the pipe 14 which is adapted for such function (not illustrated). An example of superstructure 18 applied in the form of a railing wall on a terrace above the first modular story is shown in FIG. 5.

Having so described my invention, I claim:

1. An interconnection of a structure comprizing a modular assembly and a substructure supporting said assembly at its base; said assembly consisting of several stories and composed of a plurality of self-supporting modules each having the form of a rectangular tube defined by two walls, a floor-slab and a ceiling-slab; said assembly being put together in a "wall beside wall, frontend to back-end, floor-slab over ceiling-slab" fashion;

a. said structure being interconnected vertically and laterally:

1. by rods, each extending over one story, the bottom of each rod being threaded;
rods applied at top modular story having a nut head at top;
rods applied at other stories having an immovably attached cap at top, said cap being of larger diameter than that of rod and having a threaded aperture at top designed to receive the bottom of said rods, said caps when installed projecting above the top of the modular story;

2. by pegs of generally identical shape with said rod cap, one such peg or a group of several pegs being immovably attached to a plate and such a subassembly being anchored at the top of the substructure so that pegs project above the substructure;

3. by pipes in which said rods or said pegs are encased, said pipes being embedded in walls of modules along the modular height;
a fixture of generally tubular shape being immovably attached inside each said pipe at top, the aperture of said fixture being threaded to receive bolts of the lifting device, simultaneously allowing free passage of said rods;

4. by connecting plates penetrated by several holes of which the number corresponds with the number of pipes at that particular joint, the hole diameter corresponding to the size of the said rod caps or pegs;

b. the interconnection of the hardware being accomplished so that:
rods applied at the first modular story are connected by screwing with said pegs and rods of intermediate stories are connected by screwing with one another, in either case the bottom of the rod cap resting on the top of the fixture;
rods applied at the top modular story being connected by screwing with rod caps below, the nut head of these rods resting on top of the plate applied over said pipes of the top modular story;
connecting plates applied between ceiling-slabs and floor-slabs being engaged by holes with projecting rod caps, connecting plates applied on top of the top modular story being engaged by holes with rods of the top story.

2. An interconnection of a structure as recited in claim 1,
including a plug of which the bottom is connected by screwing with the fixture described in claim 1, the upper body of said plug being identical with the upper body of the rod cap described in claim 1, said plug being connected with the bottom of the rod above.

3. An interconnection of structure as recited in claim 1,
including a rod provided at top with a nut head resting on top of the fixture described in claim 1, said fixture being recessed below the top of the pipe in which it is positioned, so that the top of said nut head is below the top of said pipe;
said rod being connected with the corresponding rod cap or with the corresponding peg below.

* * * * *